US007921748B2

(12) United States Patent
Kim et al.

(10) Patent No.: US 7,921,748 B2
(45) Date of Patent: Apr. 12, 2011

(54) PEDAL DEVICE WITH FUNCTION OF ADJUSTING PEDAL EFFORT AND HYSTERESIS

(75) Inventors: Taeho Kim, Ulsan (KR); Donghwan Kim, Ulsan (KR)

(73) Assignee: Donghee Industrial Co., Ltd., Ulsan (KR)

( * ) Notice: Subject to any disclaimer, the term of this patent is extended or adjusted under 35 U.S.C. 154(b) by 398 days.

(21) Appl. No.: 12/114,745

(22) Filed: May 3, 2008

(65) Prior Publication Data

US 2008/0276750 A1 Nov. 13, 2008

(30) Foreign Application Priority Data

May 11, 2007 (KR) ..... 10-2007-0045875

(51) Int. Cl.
*G05G 1/30* (2008.04)

(52) U.S. Cl. ..... 74/513

(58) Field of Classification Search ..... 74/512, 74/513, 560
See application file for complete search history.

(56) References Cited

U.S. PATENT DOCUMENTS

| | | | | |
|---|---|---|---|---|
| 6,070,490 | A * | 6/2000 | Aschoff et al. | 74/513 |
| 6,360,631 | B1 * | 3/2002 | Wortmann et al. | 74/513 |
| 6,758,114 | B2 * | 7/2004 | Sundaresan et al. | 74/512 |
| 7,278,337 | B2 | 10/2007 | Solta | |
| 7,296,494 | B2 | 11/2007 | Caba et al. | |
| 7,404,342 | B2 * | 7/2008 | Wurn | 74/512 |
| 7,750,258 | B2 * | 7/2010 | Lee | 200/61.89 |
| 2002/0152831 | A1 * | 10/2002 | Sakamoto et al. | 74/512 |
| 2007/0137400 | A1 * | 6/2007 | Campbell | 74/513 |

FOREIGN PATENT DOCUMENTS

| | | | |
|---|---|---|---|
| JP | 11-342762 | A | 12/1999 |
| KR | 10-2005-0048817 | A | 5/2005 |
| KR | 10-2006-0016380 | A | 2/2006 |

* cited by examiner

*Primary Examiner* — Vicky A Johnson
(74) *Attorney, Agent, or Firm* — LRK Patent Law Firm

(57) ABSTRACT

An object of the present invention is to provide a pedal device which can alleviate fatigue of a driver's ankle due to a frequent acceleration by differently setting the amount of reaction force applied when the driver presses and releases a pedal, by adjusting pre-compression force against a return spring disposed at a hinged portion of a pedal arm and adjusting a friction force on a hinged portion of the pedal arm, and satisfying a user's preference by properly adjusting the reaction force. In order to accomplish the above-mentioned object, the invention provides a pedal device with a function of adjusting a pedal effort and hysteresis that includes: a housing fixed to a car body; an arm hinged to the housing; an elastic member disposed between the housing and the pivot end of the pedal arm, and providing a return force to the pedal arm; a pedal effort adjusting unit disposed in the housing and pressing an end of the elastic member to adjust a pre-compression force to the elastic member force; and a hysteresis adjusting unit movably disposed in the housing to press the hinged portion of the pedal arm and adjusting the amount of change in stroke-to-pedal effort while the pedal arm operates.

8 Claims, 7 Drawing Sheets

PEDAL DEVICE WITH FUNCTION OF ADJUSTING PEDAL EFFORT AND HYSTERESIS

CROSS-REFERENCE TO PRIORITY APPLICATION

The benefit of priority is claimed to Republic of Korea patent application number 10-2007-0045875, filed May 11, 2007, which is hereby incorporated by reference in its entirety.

BACKGROUND

1. Field of the Invention

The present invention relates to a pedal device of a vehicle, more particularly, to an electronic pedal device detecting a level of stepping by pressing a pedal to generate an electrical signal, which can promote a change of characteristics of a pedal effort and hysteresis adapted to a driver's propensity by adjusting an elastic force of a return spring disposed at the pivot end of a pedal arm and providing a returning force, and a friction force at a hinged portion of the pedal arm.

2. Description of the Related Art

In general, a vehicle traveling is accelerated when the driver presses the pedal device and the pedal device is frequently pressed by the driver while the vehicle is traveling; therefore, research to improve the pedal response is being conducted.

Further, the pedal device for acceleration is mainly divided into a mechanical type and an electronic type. The mechanical acceleration pedal device includes an acceleration pedal that is pivotably mounted inside the vehicle room, a throttle mechanism that is provided in the intake system in the engine room, and a cable that is provided to transmit an operational force between the acceleration pedal and the throttle mechanism, connecting them.

On the other hand, an electronic acceleration pedal device includes an acceleration pedal that is pivotably mounted in the vehicle room, a pivot angle detecting sensor, such as a potentiometer, which is attached to the acceleration pedal to detect in real time the amount of pivots of the acceleration pedal.

However, in the acceleration pedal devices as described above in the related art, according to the mechanical acceleration pedal device, a hysteresis, when a reaction force applied to the driver pressing the pedal is smaller than a reaction force applied to the driver releasing the pedal due to the friction between a wire and a tube in the cable at the same time the pedal is being pressed and released, is caused. However, this has minimal effect on tuning the pedal effort.

On the contrary, according to the electronic acceleration pedal device in the related art, the amount of reacting force applied when the driver presses or releases a pedal depends on only the natural elasticity of the return spring that elastically returns the pedal arm, and the amount of reacting force is set on the basis of the pressing force for acceleration rather than on the basis of the releasing. Therefore, the electronic acceleration pedal device that generates the same magnitude of reacting force while pressing and releasing the pedal in the related art, increases the fatigue of the driver's ankle as the driver repeatedly presses and releases the pedal. As a result, this deteriorates the response of the pedal.

Further, since the reacting force depends on the natural elasticity of the return spring in the electronic acceleration pedal device in the related art, it is difficult to freely perform the tuning of pedal effort according to the driver's preference.

SUMMARY

Accordingly, the present invention is made to solve the above-mentioned problems, an object of the present invention is to provide an electronic type pedal device detecting a level of stepping by pressing a pedal to generate an electrical signal, which can alleviate fatigue of a driver's ankle due to a frequent acceleration operation by differently setting a level of reaction force that is applied to the driver at the time of stepping and releasing a pedal by adjusting a pre-compression force to a return spring disposed at the pivot end of a pedal arm and adjusting a friction force at a pivot end of the pedal arm, satisfying a user's preference by appropriately adjusting the reaction force.

In order to accomplish the above object, the present invention provides a pedal device with a function of adjusting a pedal effort and hysteresis that includes: a housing fixed to a car body; an arm hinged to the housing; an elastic member disposed between the housing and the pivot end of the pedal arm, and providing a return force to the pedal arm; a pedal effort adjusting unit disposed in the housing and pressing an end of the elastic member to adjust a pre-compression force to the elastic member force; and a hysteresis adjusting unit movably disposed in the housing to press the hinged portion of the pedal arm and adjusting the amount of change in stroke-to-pedal effort while the pedal arm operates.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION

Hereinafter, a detailed description of embodiments of the present invention will be given with reference to the accompanying drawings.

Figure 1:
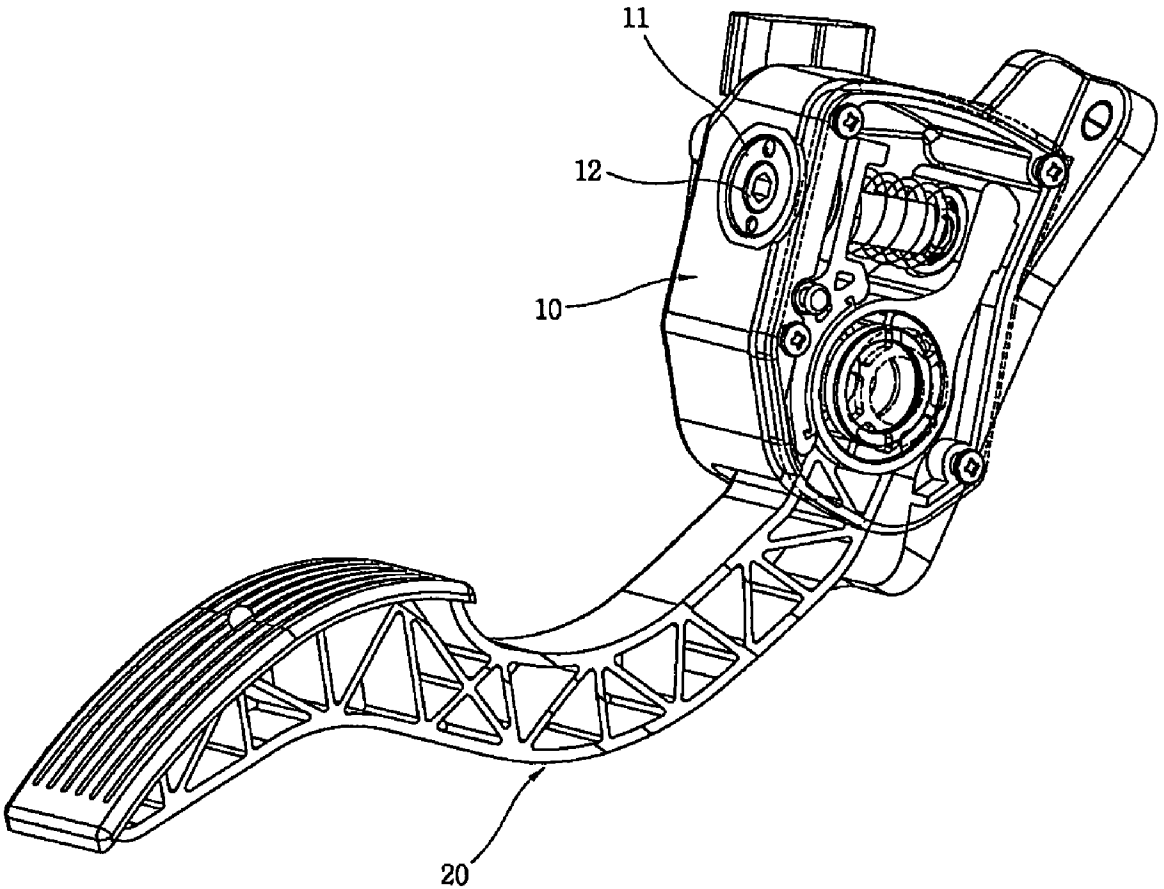
FIG. 1 is a perspective view showing a configuration of a pedal device having a function of adjusting a pedal effort and hysteresis according to the invention.

As shown in FIG. 1, an electric pedal device according to an embodiment of the invention includes a housing 10 that is fixed to a car body, a pedal arm 20 that is hinged to the housing 10 and pivots about the housing 10, and an elastic member that is disposed between the housing 10 and the pivot end of the pedal arm 20 and provides a return force to the pedal arm 20.

Further, the electronic pedal device according to an embodiment of the invention further includes a pedal effort adjusting unit and a hysteresis adjusting unit. The pedal effort adjusting unit is disposed at the housing 10 and presses an end of the elastic member to adjust a pre-compression force to the elastic member, thereby adjusting a pedal effort to the pedal arm 20. The hysteresis adjusting unit is movably disposed at the housing 10 to press the hinged portion of the pedal arm 20 and adjusts the amount of change in stroke-to-pedal effort when the pedal arm 20 pivots and returns.

Figure 2:
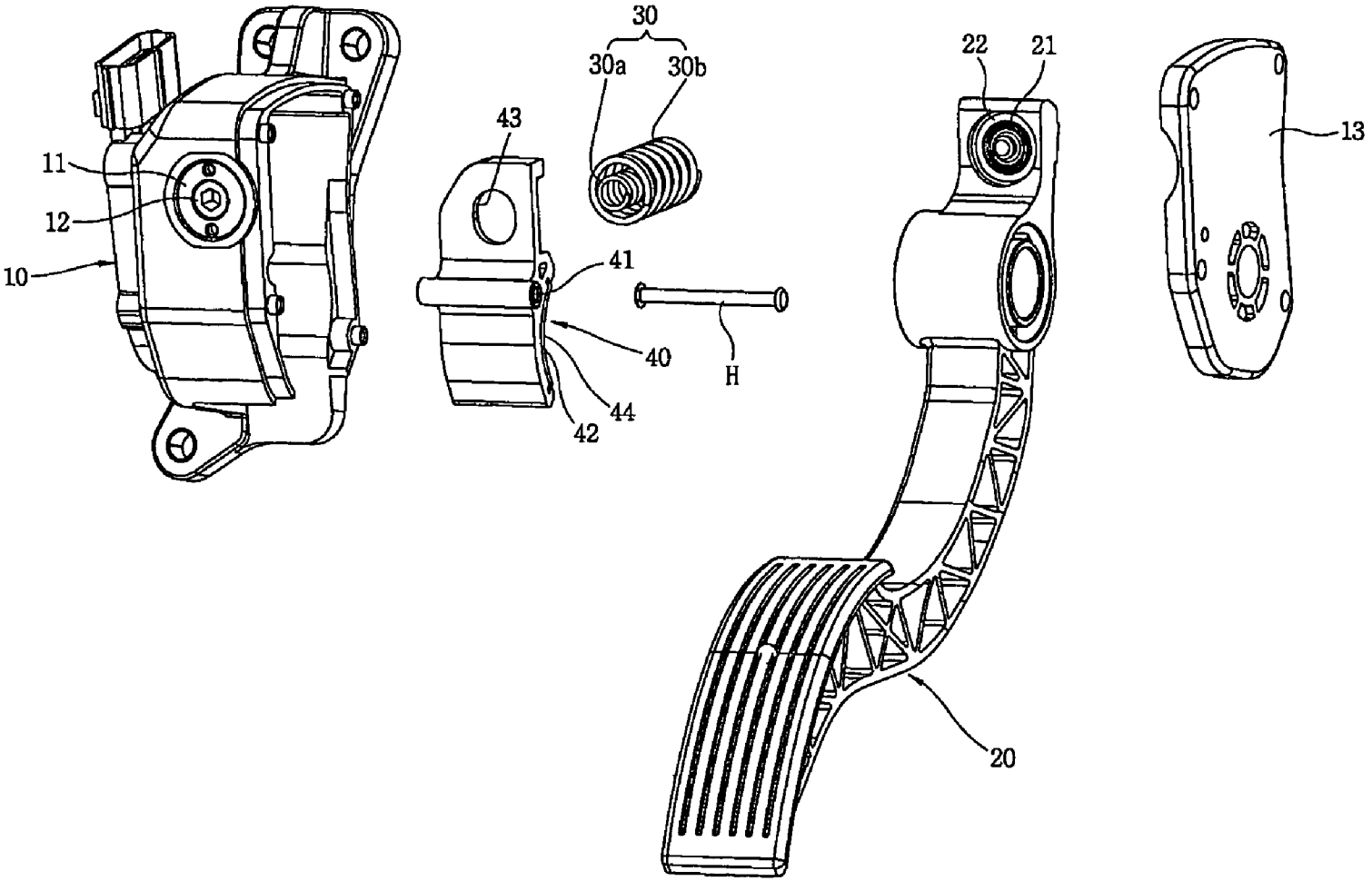
FIG. 2 is an exploded perspective view of FIG. 1
Figure 3:
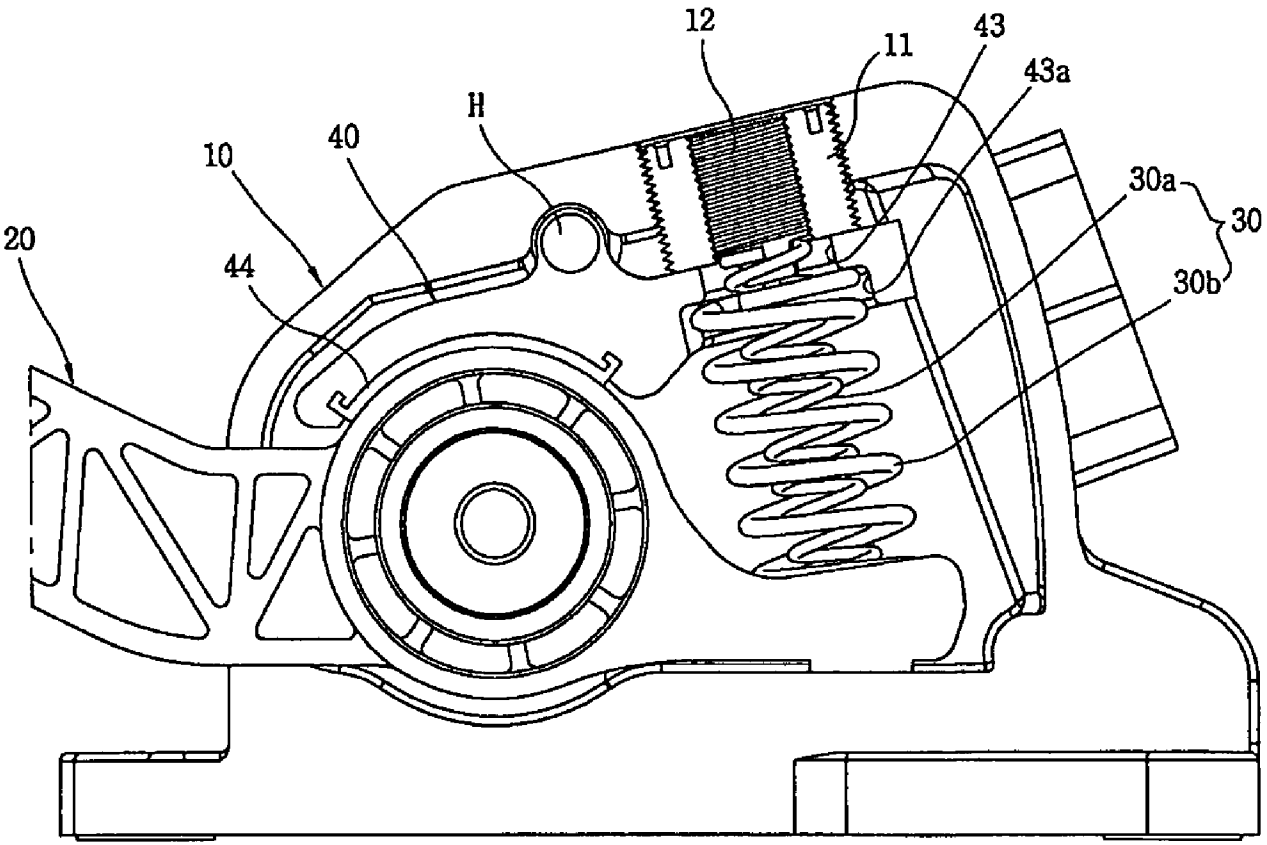
FIG. 3 is a cross-sectional view of the main parts in the configuration state of a pedal effort adjusting unit and a hysteresis adjusting unit.

As shown in FIGS. 2 and 3, the clastic member is composed of a double coil spring 30 disposed between the housing 10 and the pivot end of the pedal arm 20, and in detail, the coil spring is composed of a large-diameter spring 30*b* and a small-diameter spring 30*a* that is coaxially disposed at a predetermined distance inside the large-diameter spring 30*b*.

In this case, the lower ends of the small-diameter coil spring 30*a* and the large-diameter coil spring 30*b* are supported by the pivot end of the pedal arm 20, while the upper end of the small-diameter coil spring 30*a* is supported by an inner adjusting bolt 12 that is described below and the upper end of the large-diameter coil spring 30*b* is supported by the upper end of an outer adjusting bolt 11.

Concentric seating grooves 21 and 22 are provided in the pivot end of the pedal arm 20 to support the lower ends of the small-diameter coil spring 30*a* and the large-diameter coil spring 30*b*. The small-diameter coil spring 30*a* and the large-diameter coil spring 30*b* may be disposed at the pivot end of the pedal arm 20 without interference.

Figure 4:
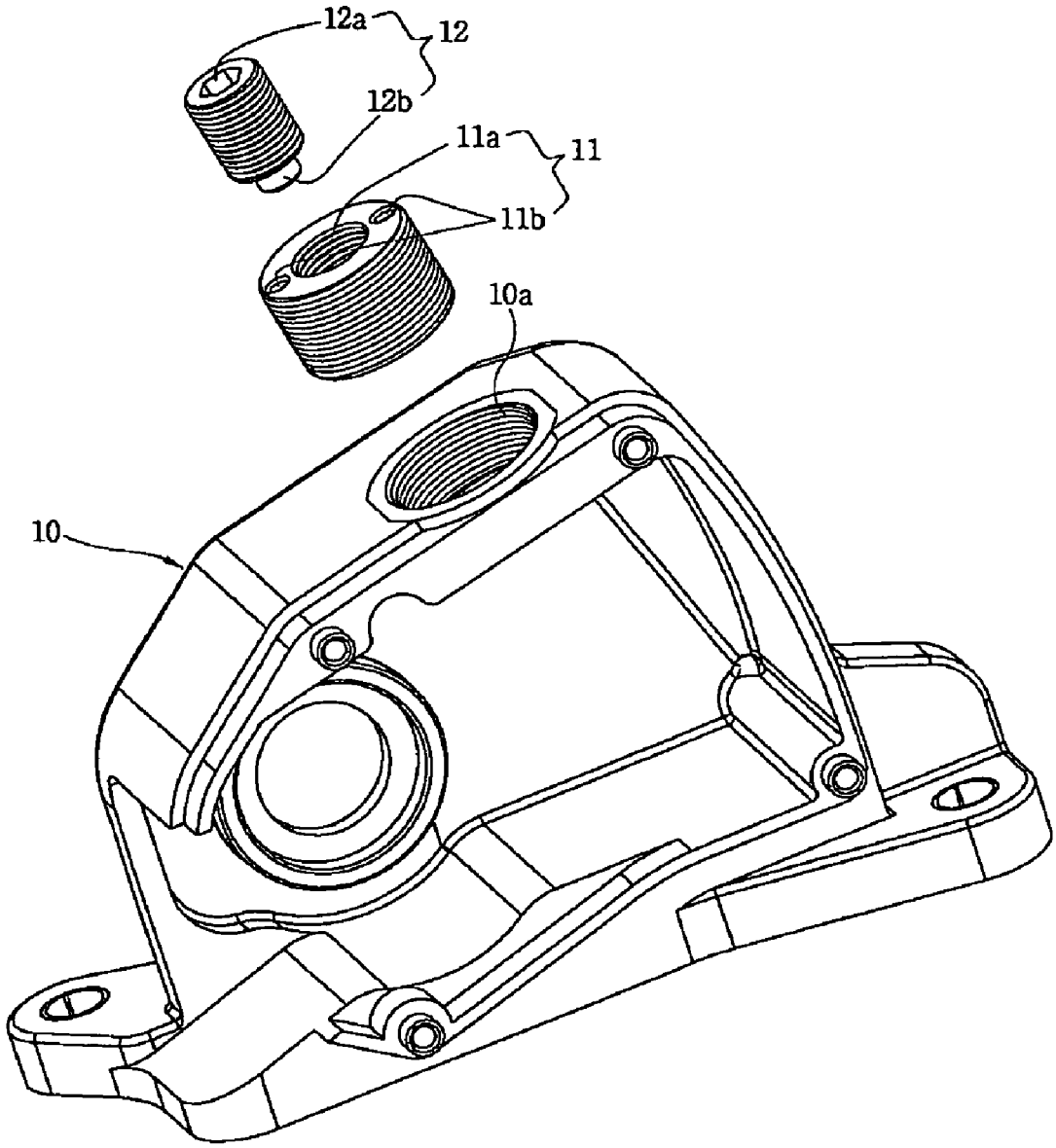
FIG. 4 is an exploded perspective view of an outer adjusting bolt and an inner adjusting bolt coupled with the housing.

As shown in FIG. 4, the pedal effort adjusting unit includes the outer adjusting bolt 11 inserted in a first fastening hole 10*a* and having an additional second fastening hole 11*a* at the center of the outer adjusting bolt 11 and the inner adjusting bolt 12 inserted in the second fastening hole 11*a* and presses the upper end of the small-diameter coil spring 30*a*.

In this case, the outer adjusting bolt 11 can adjust the amount of pre-compression force to an end of the large-diameter coil spring 30*b* according to the insertion depth in the first fastening hole 10*a*. The inner adjusting bolt 12 can adjust the amount of pre-compression force to an end of the small-diameter coil spring 30*a*.

A pair of tool grooves 11*b* spaced apart from each other to insert a U-shaped tool is formed on the upper surface of the outer adjusting bolt 11. A tool groove 12*a* for inserting a wrench is formed at the center of the upper portion of the inner adjusting bolt 12. Accordingly, the tool grooves 11*b* and 12*a* facilitates individually adjusting the insertion depth of the outer adjusting bolt 11 and the inner adjusting bolt 12 in the first fastening hole 10*a* and the second fastening hole 11*a*.

A protruding boss 12*b* for fitting and supporting the upper end of the small-diameter coil spring 30*a* is formed at the lower portion of the inner adjusting bolt 12. Therefore, the inner adjusting bolt 12 and the small-diameter coil spring 30*a* are more firmly coupled with each other.

Figure 5:
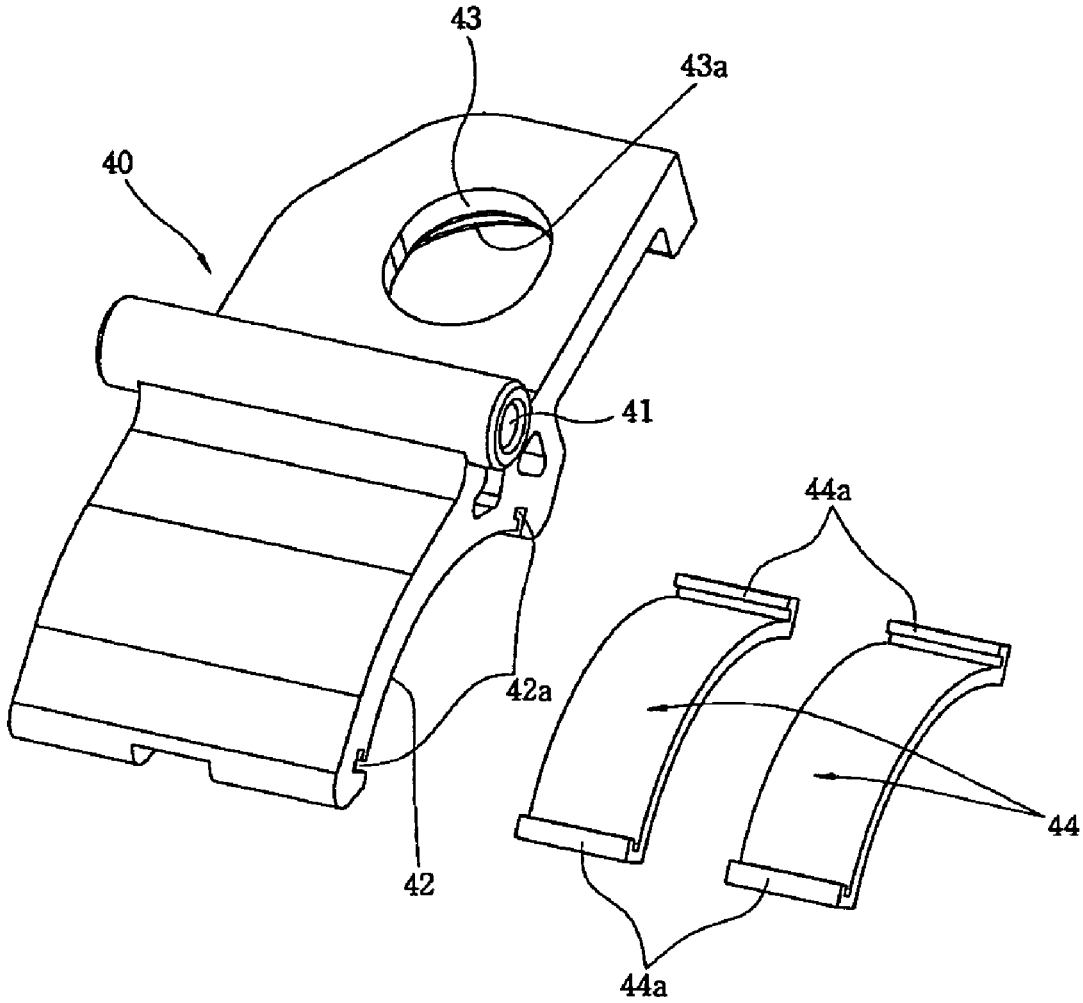
FIG. 5 is an exploded perspective view of a friction arm and a friction plate.

As shown in FIGS. 2 and 5, the hysteresis adjusting unit includes a friction arm 40 of which the center portion of the friction arm 40 is hinged to the housing 10 by a hinge pin H, an end is in contact with the hinged portion of the pedal arm, and the other end through which the small-diameter coil spring 30*a* passes is supported by the upper end of the large-diameter coil spring 30*b* to be in contact with the bottom of the outer adjusting bolt 11.

A fastening hole 41 in which the hinge pin H is inserted is formed at the center portion of the friction arm 40. A curved concave contact surface 42 is formed at an end of the friction arms 40 to be in contact with the hinged portion of the pedal arm 20. A through hole 43 is formed at the other end of the friction arm 40, through which the upper end of the small-diameter coil spring 30*a* passes such that the upper end of the large-diameter coil spring 30*b* contacts with the friction plate 40.

In this case, a friction plate 44 is attached to the contact surface 42 to improve a friction force and durability when contacting with the hinged portion of the pedal arm 20. The friction plate 44 is preferably made of a material having high durability in consideration of abrasion due to the friction, in addition to improving the friction force generated when contacting with the hinged portion of the pedal arm 20.

Grooves 42*a* are formed at both ends of the contact surface 42. Curve portions 44*a* integrally formed with both ends of the friction plate 44 are inserted in the grooves 42*a*. Therefore, the friction plate 44 is firmly fixed to the contact surface 42.

An enlarged stepped seating groove 43*a* is formed on the bottom of the through-hole 43 to be in close contact with the upper end of the large-diameter coil spring 30*b*. Therefore, the upper end of the large-diameter coil spring 30*b* can be held at the position while being prevented from the seating groove 43*a*.

A cover plate 13 for receiving the coil spring 30 and the friction arm 40 is fastened to a side of the housing 10. The cover plate 13 prevents the parts from being separated outside the housing 10 by being attached after the pedal arm 20, the coil spring 30, and the friction arm 40 are disposed in the housing 10.

Hereinafter, the operation of the pedal device having a function of adjusting the pedal effort and the hysteresis according to an embodiment of the invention will be described in detail.

First, the pedal effort to the pedal arm 20 is adjusted by adjusting the inner adjusting bolt 12 inserted in the second fastening hole 11*a* of the outer adjusting bolt 11. As the insertion depth of the inner adjusting bolt 12 with respect to the outer adjusting bolt 11 is adjusted, the pre-compression force applied an end of the small-diameter coil spring 30*a* is adjusted. Therefore, the amount of the pedal effort applied when the pedal arm 20 operates can be variably adjusted.

Figure 6:
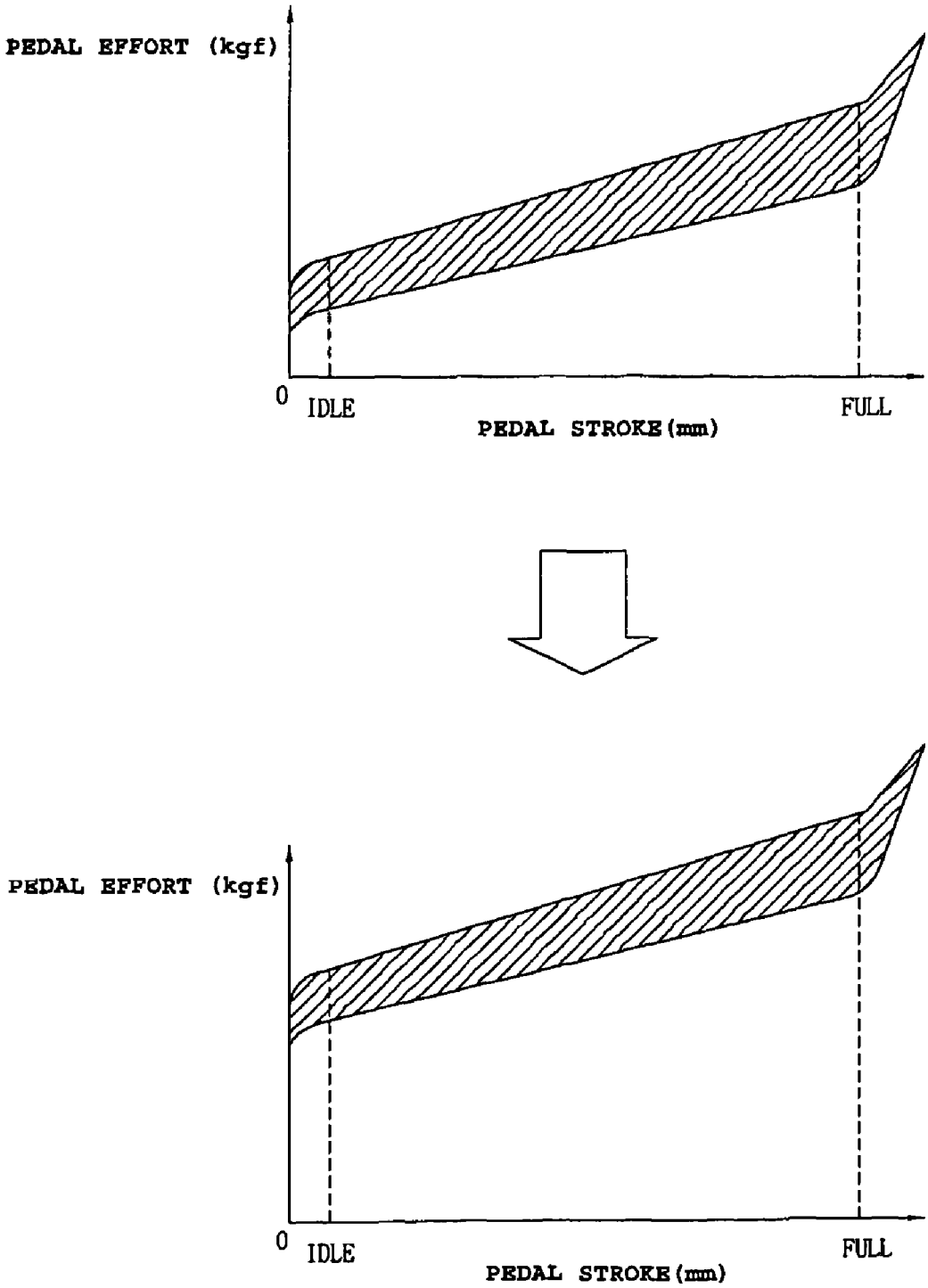
FIG. 6 shows graphs illustrating changes in stroke-to-pedal effort when a pedal operates, before and after the pedal effort is adjusted.

That is, as shown in FIG. 6, when the pre-compression force to the small-diameter coil spring 30 is adjusted by adjusting the inner adjusting bolt 12, the pedal effort-to-pedal stroke is varied.

In this case, the variation of the pedal effort of the pedal can be properly adjusted within a minute range by adjusting the insertion depth of the inner adjusting bolt 12 in the second fastening hole 11*a* of the outer adjusting bolt 11.

The hysteresis to the pedal arm 20 is adjusted by adjusting the insertion depth of the outer adjusting bolt 11 in the first fastening hole 10*a* of the housing 10. When the insertion depth of the outer adjusting bolt 11 in the housing 10 is adjusted, the pre-compression force to an end of the large-diameter coil spring 30*b* is correspondingly adjusted. Accordingly, the friction force generated between the friction plate 44 at the other front end of the friction arm 40 and the hinged portion of the pedal arm 20 is adjusted. As a result, the stroke-to-pedal effort of the pedal when the pedal arm 20 operates is varied.

Figure 7:
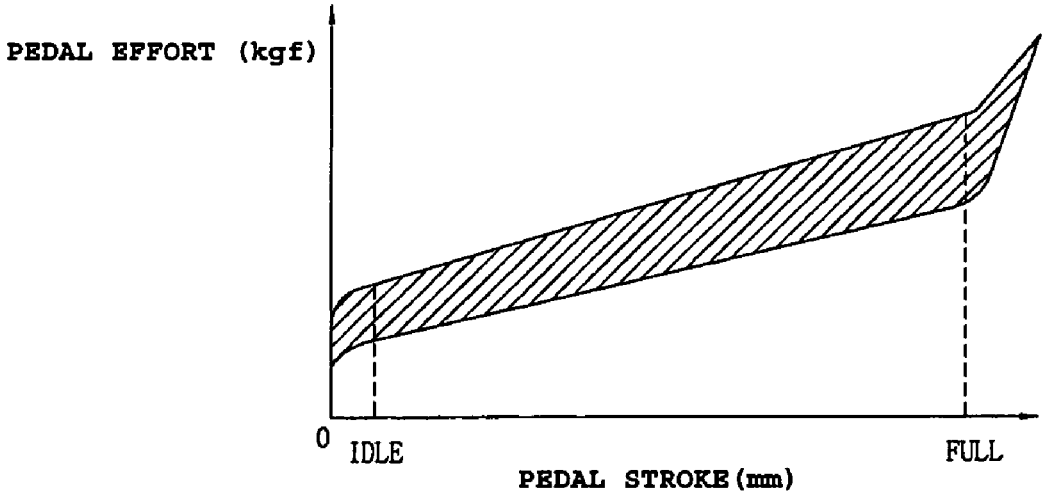
FIG. 7 shows graphs illustrating changes in stroke-to-pedal effort when the pedal operates, before and after the hysteresis is adjusted.
Figure 7:
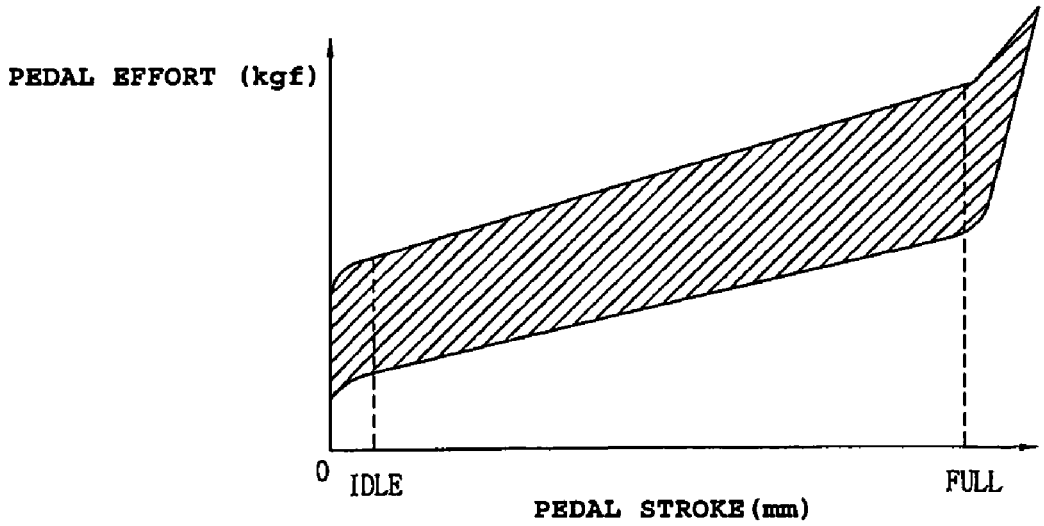

That is, as shown in FIG. 7, as the amount of the contact between the friction plate 44 and the hinged portion of the pedal arm 20 is adjusted by adjusting the position of the outer adjusting bolt 11 with respect to the housing 10, the stroke-to-pedal effort is varied while the pedal is pressed and released.

In this case, the variation of the hysteresis of the pedal can be properly adjusted within a minute range by adjusting the position of the outer adjusting bolt 11 with respect to the fastening hole 10*a* of the housing 10.

As described above, by a pedal device having a function of adjusting according to an embodiment of the invention, accumulation of fatigue of a driver's ankle at the time of driving a vehicle can be alleviated by differently setting the amount of reaction force applied when a driver presses are releases the pedal and the amount of reaction force can be flexibly adjusted to adapt to driver's propensity. Therefore it is possible to improve a product value of the pedal device.

Further, according to an embodiment of the invention, a product performance can be stabilized by reducing the dispersion of a quality in producing the pedal device through flexible adjustment of the pedal effort of the pedal device and tuning of operability according to output characteristics of the engine can be easily performed when the pedal device is applied to vehicles of different type vehicles.

What is claimed is:

1. A pedal device with a function of adjusting a pedal effort and hysteresis, the pedal device comprising:

a housing;

a pedal arm hinged to the housing;

an elastic member disposed between the housing and the pivot end of the pedal arm, and providing a return force to the pedal arm;

a pedal effort adjusting unit disposed in the housing and pressing an end of the elastic member to adjust a pre-compression force to the elastic member force; and a hysteresis adjusting unit movably disposed in the housing to press the hinged portion of the pedal arm and adjusting the amount of change in stroke-to-pedal effort while the pedal arm operates, wherein the elastic member is composed of a large-diameter spring and a small-diameter spring that is coaxially disposed at a predetermined distance inside the large-diameter spring, the pedal effort adjusting unit includes an outer adjusting bolt inserted in a first fastening hole and having an additional second fastening hole at the center of the outer adjusting bolt, and an inner adjusting bolt inserted in the second fastening hole and pressing an upper end of the small-diameter coil spring, the hysteresis adjusting unit includes a friction arm of which the center portion is hinged to the housing by a hinge pin, an end is in contact with the hinged portion of the pedal arm, and an opposite end has a through-hole through which the small-diameter coil spring passes, and is supported by an upper end of the large-diameter coil spring to be in contact with the outer adjusting bolt, and a fastening hole in which the hinge pin is inserted is formed at the center portion of the friction arm, a curved concave contact surface is formed at an end of the friction arm to be in contact with the hinged portion of the pedal arm, and a through-hole is formed at an opposite end of the friction arm through which the small-diameter coil spring passes such that the upper end of the large-diameter coil spring contacts with the friction arm.

2. The pedal device as set forth in claim 1, wherein concentric seating grooves are formed at the pivot end of the pedal arm to support the small-diameter coil spring and the large-diameter coil spring.

3. The pedal device as set forth in claim 1, wherein a tool grooves spaced apart from each other to insert a tool is formed on a top surface of the outer adjusting bolt and a tool groove in which the tool is inserted is formed at the center on a top surface of the inner adjusting bolt.

4. The pedal device as set forth in claim 1, wherein a projecting boss that is fitted in and supports the upper end of the small-diameter coil spring is integrally formed to the bottom of the inner adjusting bolt.

5. The pedal device as set forth in claim 1, wherein a friction plate is attached to the contact surface to improve friction force and durability while contacting with the hinged portion of the pedal arm.

6. The pedal device as set forth in claim 5, wherein grooves are formed at both ends of the contact surface and a curved portion integrally formed with both ends of the friction plate are inserted in the grooves.

7. The pedal device as set forth in claim 1, wherein a stepped seating groove is formed on the bottom portion of the through-hole to be in close contact with the upper end of the large-diameter coil spring.

8. The pedal device as set forth in claim 1, wherein a cover plate for receiving the small-diameter coil spring, the large-diameter coil spring and the friction arm is fastened to a side of the housing.

* * * * *